US007980833B1

(12) United States Patent
Golden, III

(10) Patent No.: US 7,980,833 B1
(45) Date of Patent: Jul. 19, 2011

(54) MOTOR AND PUMP SHAFT CONNECTING ASSEMBLY WITH LIFTING JACK

(75) Inventor: Hubert F. Golden, III, Downers Grove, IL (US)

(73) Assignee: Pentair Pump Group, Inc., Golden Valley, MN (US)

( * ) Notice: Subject to any disclaimer, the term of this patent is extended or adjusted under 35 U.S.C. 154(b) by 194 days.

(21) Appl. No.: 11/324,916

(22) Filed: Jan. 4, 2006

(51) Int. Cl.
*F04B 17/03* (2006.01)

(52) U.S. Cl. ..... 417/360; 403/16; 403/312

(58) Field of Classification Search ..... 403/310, 403/312, 338, 344, 16; 464/182; 285/373, 285/419; 417/359, 360
See application file for complete search history.

(56) References Cited

U.S. PATENT DOCUMENTS 3,048,177 A * 8/1962 Takaro ..... 285/419
3,252,192 A * 5/1966 Smith ..... 285/367
3,838,987 A 10/1974 Draut
3,851,983 A 12/1974 MacKenzie
4,240,762 A 12/1980 Lobanoff
5,090,742 A * 2/1992 Cohen et al. ..... 285/373
5,154,652 A 10/1992 Ecklesdafer
5,208,569 A 5/1993 Michelangelo et al.
5,379,519 A 1/1995 Paddock et al.
5,676,183 A * 10/1997 Bravo ..... 285/419
6,824,471 B2 11/2004 Kamenov

* cited by examiner

*Primary Examiner* — Michael P Ferguson
(74) *Attorney, Agent, or Firm* — Quarles & Brady, LLP

(57) ABSTRACT

The present invention relates to a coupling assembly used to connect a rotatable motor shaft to a drive shaft in, for example, a fluid pump. In one embodiment, the coupling assembly of the present invention includes a seal gland that doubles as a jacking gland, thereby facilitating both the raising and/or lowering of a fluid pump's shaft and impeller assembly from the pump's motor. In another embodiment, the coupling assembly of the present invention includes a seal gland having therein one or more connectors that enable the seal gland to be raised and lowered relative the position of the pump's motor. In still another embodiment, the present invention relates to a method for replacing the mechanical seal in the casing portion of a fluid pump.

4 Claims, 5 Drawing Sheets

MOTOR AND PUMP SHAFT CONNECTING ASSEMBLY WITH LIFTING JACK

FIELD OF THE INVENTION

The present invention relates to a coupling assembly used to connect a rotatable motor shaft to a drive shaft in, for example, a fluid pump. In one embodiment, the coupling assembly of the present invention includes a seal gland that doubles as a jacking gland, thereby facilitating both the raising and/or lowering of a fluid pump's shaft and impeller assembly from the pump's motor. In another embodiment, the coupling assembly of the present invention includes a seal gland having therein one or more connectors that enable the seal gland to be raised and lowered relative the position of the pump's motor. In still another embodiment, the present invention relates to a method for replacing the mechanical seal in the casing portion of a fluid pump.

BACKGROUND OF THE INVENTION

Coupling assemblies are known in the art. In one instance, coupling assemblies can be used to connect, in an axially aligned orientation, the end of a drive shaft in a casing portion of a fluid pump to the end of a motor shaft in a motor portion of a fluid pump. Conventional coupling assemblies typically consist of a two-part sleeve (i.e., a split rigid coupling) which when assembled define a centrally extending bore into which end portions of the motor shaft and drive shaft are located. Screws, pins or other retaining configurations are used to physically couple each of the motor shaft and drive shaft to the sleeve, thereby mechanically connecting the drive shaft to the motor shaft.

In conventional fluid pumps, and particularly vertical in-line pumps, the drive shaft consists of a pump or impeller shaft to which is connected to a fluid impeller. The impeller is in turn rotatable within a fluid housing to pump the fluid therethrough. When servicing fluid pumps having a motor shaft and a pump shaft joined via a split rigid coupling, once the split rigid coupling is removed the impeller is free to drop down onto any protrusion (e.g., a shoulder) that may be present within the pump casing. After servicing is complete, the pump shaft and impeller must be raised vertically in order to re-couple the pump shaft to the motor shaft via the split rigid coupling. For a variety of reasons, this operation can be difficult for one person to accomplish safely and efficiently.

Thus, there is a need in the art for a coupling assembly that permits the easy and efficient servicing of fluid pumps (e.g., in-line vertical centrifugal pumps).

SUMMARY OF THE INVENTION

The present invention relates to a coupling assembly used to connect a rotatable motor shaft to a drive shaft in, for example, a fluid pump. In one embodiment, the coupling assembly of the present invention includes a seal gland that doubles as a jacking gland, thereby facilitating both the raising and/or lowering of a fluid pump's shaft and impeller assembly from the pump's motor. In another embodiment, the coupling assembly of the present invention includes a seal gland having therein one or more connectors that enable the seal gland to be raised and lowered relative the position of the pump's motor. In still another embodiment, the present invention relates to a method for replacing the mechanical seal in the casing portion of a fluid pump.

In one embodiment, the present invention relates to a coupling assembly for connecting a driven shaft to a motor shaft, the coupling assembly comprising: a split coupling sleeve that is elongated in an axial direction from a forward end to a rearward end, the sleeve defining an axially located central bore, a first end of the central bore extending into the forward end of the coupling sleeve and being sized to at least partially receive therein an endmost portion of the motor shaft, the second other end of the central bore extending into the rearward end of the coupling sleeve and being sized to at least partially receive therein an endmost portion of a the driven shaft; a seal gland defining an open interior sized for circumferential placement about the driven shaft and being secured against axially sliding movement relative thereto, the seal gland including at least one aperture open in an axial direction; and at least one connector being insertable axially through the at least one aperture in the seal gland, whereby the engagement of the connector with the seal gland permits movement of the seal gland in an axial direction relative to the split coupling sleeve and motor shaft after the seal gland has been unsecured.

In another embodiment, the present invention relates to a coupling assembly for connecting a driven shaft to a selectively rotatable motor shaft for rotation therewith, the coupling assembly comprising: a split coupling sleeve that is elongated in an axial direction from a forward end to a rearward end, the sleeve defining an axially located central bore, a first end of the central bore extending into the forward end of the coupling sleeve and being sized to at least partially receive therein an endmost portion of the motor shaft, the second other end of the central bore extending into the rearward end of the coupling sleeve and being sized to at least partially receive therein an endmost portion of a the driven shaft; a seal gland defining an open interior sized for circumferential placement about the driven shaft and being secured against axially sliding movement relative thereto, the seal gland including at least two apertures open in an axial direction; at two connectors, each connector being insertable axially through one of the least two apertures in the seal gland, whereby the engagement of the connectors with the seal gland permits movement of the seal gland in an axial direction relative to the split coupling sleeve and motor shaft after the seal gland has been unsecured; and at least one stopping structure located on the driven shaft, the stopping structure being designed to limit the axial movement of the seal gland, wherein each of the at least two connectors are a threaded connector and wherein each of the at least two threaded connectors further comprises a threaded nut that enables the movement of the seal gland in the axial direction relative to the split coupling sleeve and motor shaft.

In still another embodiment, the present invention relates to a method for servicing a fluid pump the pump including a seal gland, a motor shaft, a driven shaft having an impeller assembly attached thereto, and a coupling assembly designed to join the motor shaft to the driven shaft, the method comprising the steps of: (A) raising a seal gland using a seal gland movement means in order to lend alternative support to the driven shaft; (B) disconnecting the coupling assembly from the motor shaft and the driven shaft; (C) lowing the seal gland using the seal gland movement means until the impeller assembly of the driven shaft comes to rest in the fluid pump; and (D) servicing the fluid pump.

DETAILED DESCRIPTION OF THE INVENTION

The present invention relates to a coupling assembly used to connect a rotatable motor shaft to a drive shaft in, for example, a fluid pump. In one embodiment, the coupling assembly of the present invention includes a seal gland that doubles as a jacking gland, thereby facilitating both the raising and/or lowering of a fluid pump's shaft and impeller assembly from the pump's motor. In another embodiment, the coupling assembly of the present invention includes a seal gland having therein one or more connectors that enable the seal gland to be raised and lowered relative the position of the pump's motor. In still another embodiment, the present invention relates to a method for replacing the mechanical seal in the casing portion of a fluid pump.

Figure 1:
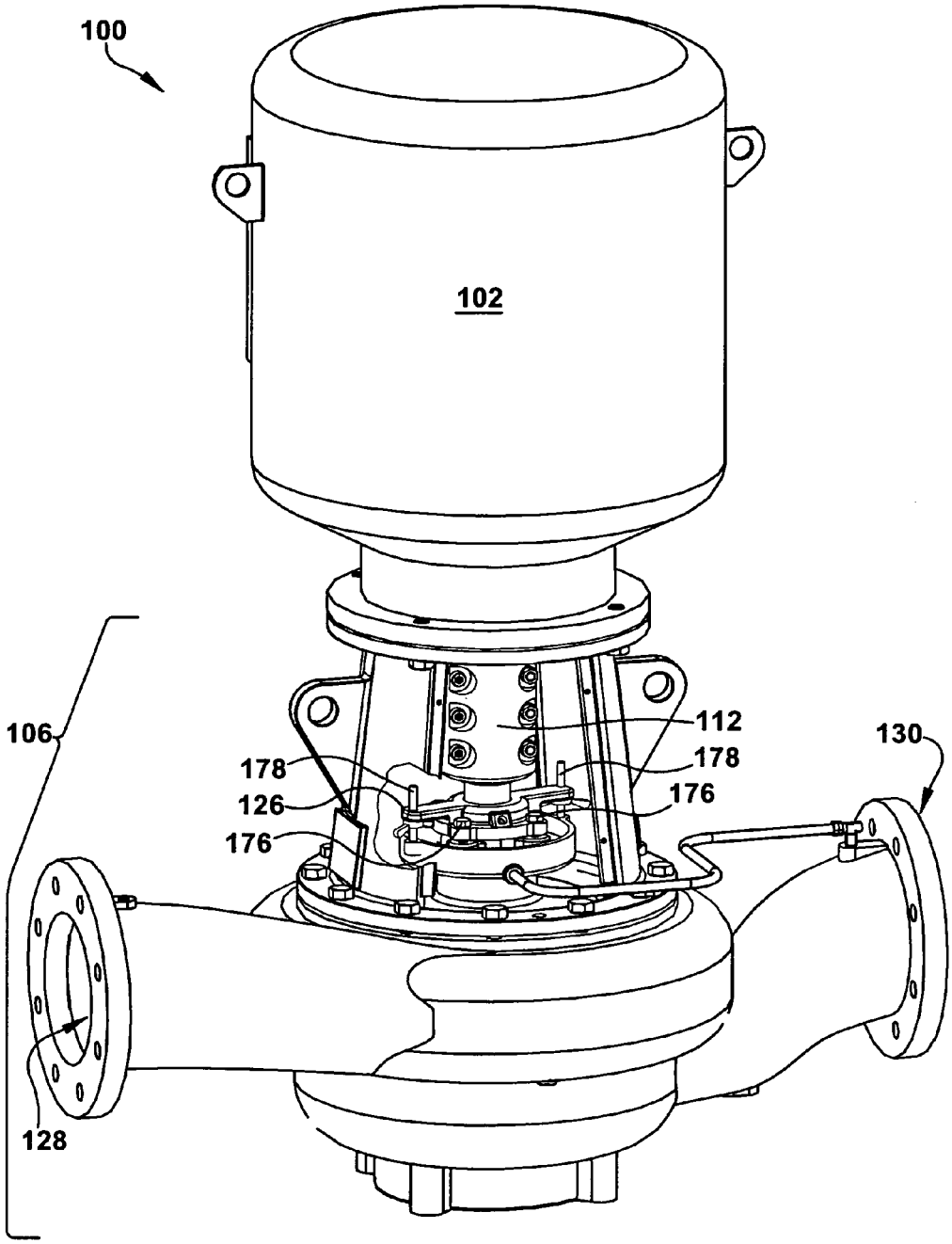
FIG. 1 illustrates a fluid pump having a coupling assembly and jacking assembly in accordance with one embodiment of the present invention.
Figure 2:
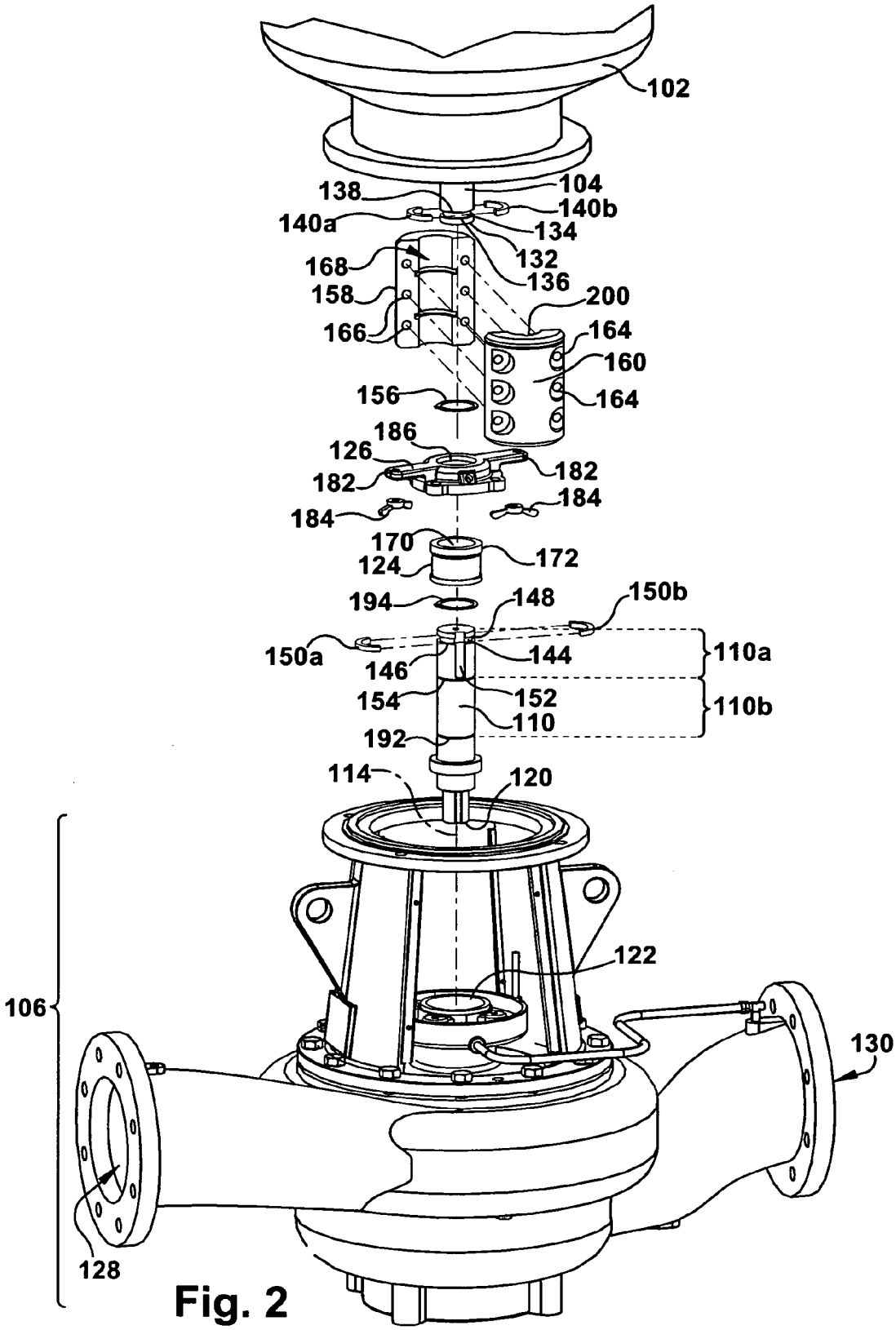
FIG. 2 illustrates a partially exploded view of the fluid pump of FIG. 1.

Turning to FIGS. 1 through 5, FIGS. 1 through 5 together illustrate a vertical in-line water pump 100 in accordance with one of several embodiments of the present invention. The pump 100 includes an electric motor 102 having a rotatable motor shaft 104, a pump housing and/or casing 106, a rotatable impeller assembly 108, a pump shaft 110, and a motor/pump shaft split coupling assembly 112 used to couple the pump shaft 110 and the impeller assembly 108 to the motor shaft 104 for rotation therewith. The motor 102 is mounted to an upper portion of the pump housing 106 with the pump shaft 110 aligned with and rotatable about a vertical axis represented by vertical dashed line 114 (FIG. 2). The impeller assembly 108 consists of an impeller 116 which is rotatably disposed within an impeller housing 118 and secured to a lower end 120 of pump shaft 110 via any suitable means. Suitable means for securing impeller assembly 108 to pump shaft 110 include, but are not limited to, a bolt, a screw, a rivet, or a weld. In one embodiment, impeller assembly 108 is removably secured to pump shaft 110 via a bolt or a screw. The pump shaft 110 extends vertically through an upper opening 122 in housing 106 in alignment with the vertical dashed line 114 and is coupled in axial alignment with motor shaft 104 by split coupling assembly 112. A suitable mechanical seal 124 and seal gland 126 are provided on the pump shaft 110. Pump casing 106 also contains therein fluid inlet 128 and fluid outlet 130.

Figure 5:
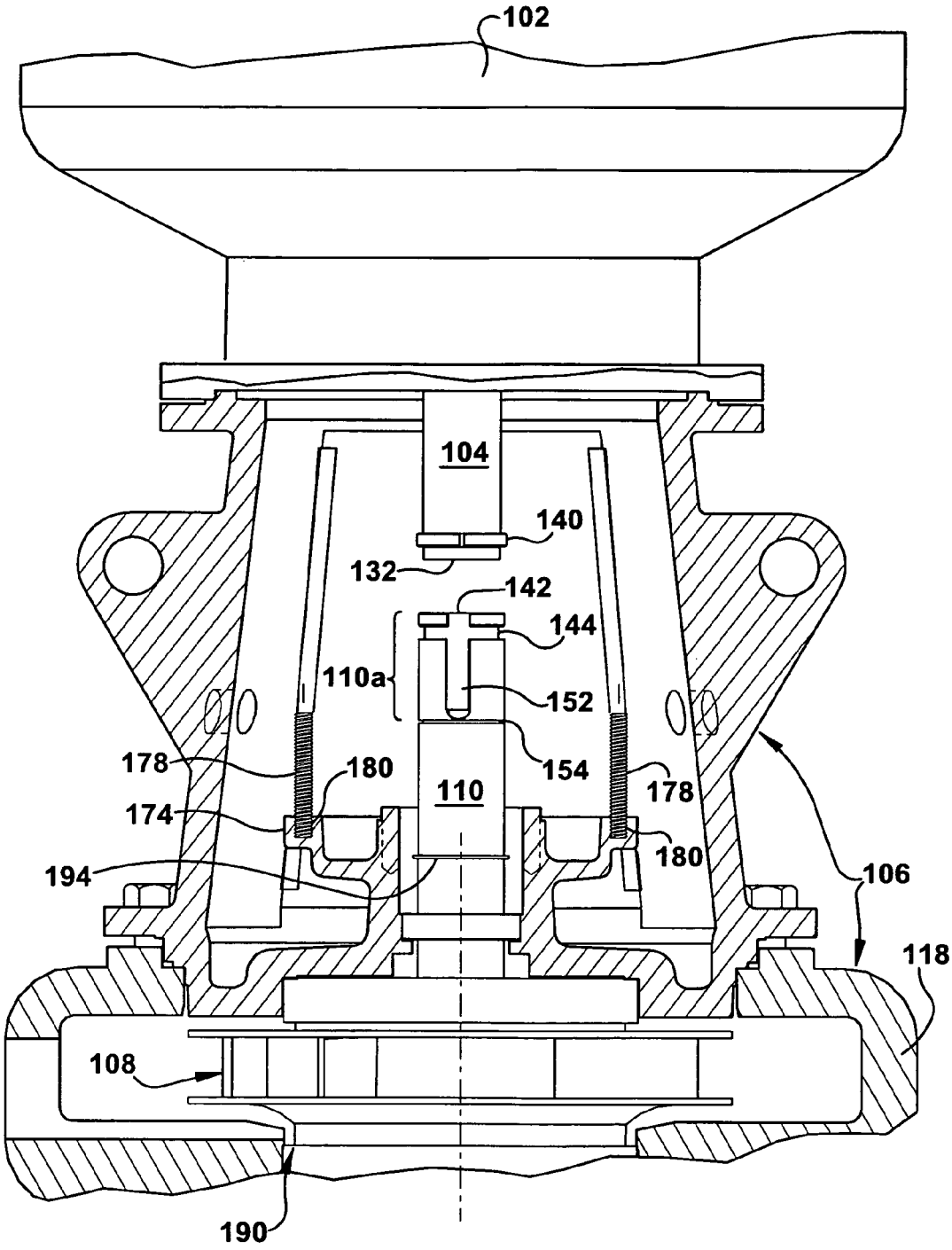
FIG. 5 illustrates a partial cross-section view of the coupling assembly and jacking assembly of FIG. 1 in a disassembled position.

As can be seen in FIG. 2, the lowermost end portion of the motor shaft 104 is generally cylindrical in shape and rotatable about a vertical axis represented by vertical dashed line 114. Motor shaft 104 has a radial diameter D and an end 132. An annular groove 134, having a radial diameter d, which is selected to be less than diameter D, is formed about motor shaft 104 at a location near end 132. The reduced diameter of annular groove 134 defines a pair of radially extending shoulders 136 and 138 which define respectively the forward and rearward edges of annular groove 134. Annular groove 134 is formed so as to be able to receive a key 140 (FIG. 5). Key 140 is formed from two semi-circular portions 140*a* and 140*b* (FIG. 2). Although not shown in the Figures, motor shaft 104 has formed therein a keyway that extends axially along a radial edge portion of motor shaft 104 opening into the end 132 of motor shaft 104. This keyway is formed such that it can receive a suitably sized key (not shown). The key in the keyway of the motor shaft engages a corresponding surface on the interior surface of one portion of split coupling assembly 112 (the slight notch 200 shown at the top end of sleeve half 160 in FIG. 2) so as to permit the securing of split coupling assembly 112 to motor shaft 104. The keyway and key of motor shaft 104 are similar to those found on pump shaft 110 as will be explained in more detail below.

Pump shaft 110 is also shown as being generally cylindrical and, in assembly of the pump 100, is secured in a position that is axially aligned with motor shaft 104 for rotation about an axis represented by vertical dashed line 114. Pump shaft 110 extends from a lower end 120, to which impeller assembly 108 is secured, to an upper end 142. The upper portion 110*a* of pump shaft 110 has a radial diameter $D_1$. The diameter $D_1$ of upper pump shaft portion 110*a* can be greater, equal or smaller in size than the diameter D of motor shaft 104 depending on the overall mass and applied forces of impeller assembly 108. An annular groove 144, having a radial diameter $d_1$, which is selected to be less than diameter $D_1$, is formed about pump shaft 110 at a location near the upper end 142. The reduced diameter of annular groove 144 defines a pair of radially extending shoulders 146 and 148 which define respectively the forward and rearward edges of annular groove 144. Annular groove 144 is formed so as to be able to receive a key 150 (FIG. 5). Key 150 is formed from two semi-circular portions 150*a* and 150*b* (FIG. 2). A keyway 152 extends axially along a radial edge portion of pump shaft 110 opening into the end 142 of pump shaft 110. Keyway 152 is formed such that it can receive a suitably sized key (not shown). The key in keyway 152 engages a corresponding surface on the interior surface of one portion of split coupling assembly 112 (not shown) so as to permit the securing of split coupling assembly 112 to pump shaft 110.

The diameter of the remainder of pump shaft 110 between the end of upper portion 110*a* and end 120 can be equal to, smaller than, or greater than the diameter $D_1$, depending upon the configuration of impeller assembly 108. Pump shaft 110 also includes a second annular groove 154 that is designed to receive a retaining ring 156. The function of retaining ring 156 will be discussed below in connection with the method/steps used disassemble pump 100 for servicing.

Figure 3:
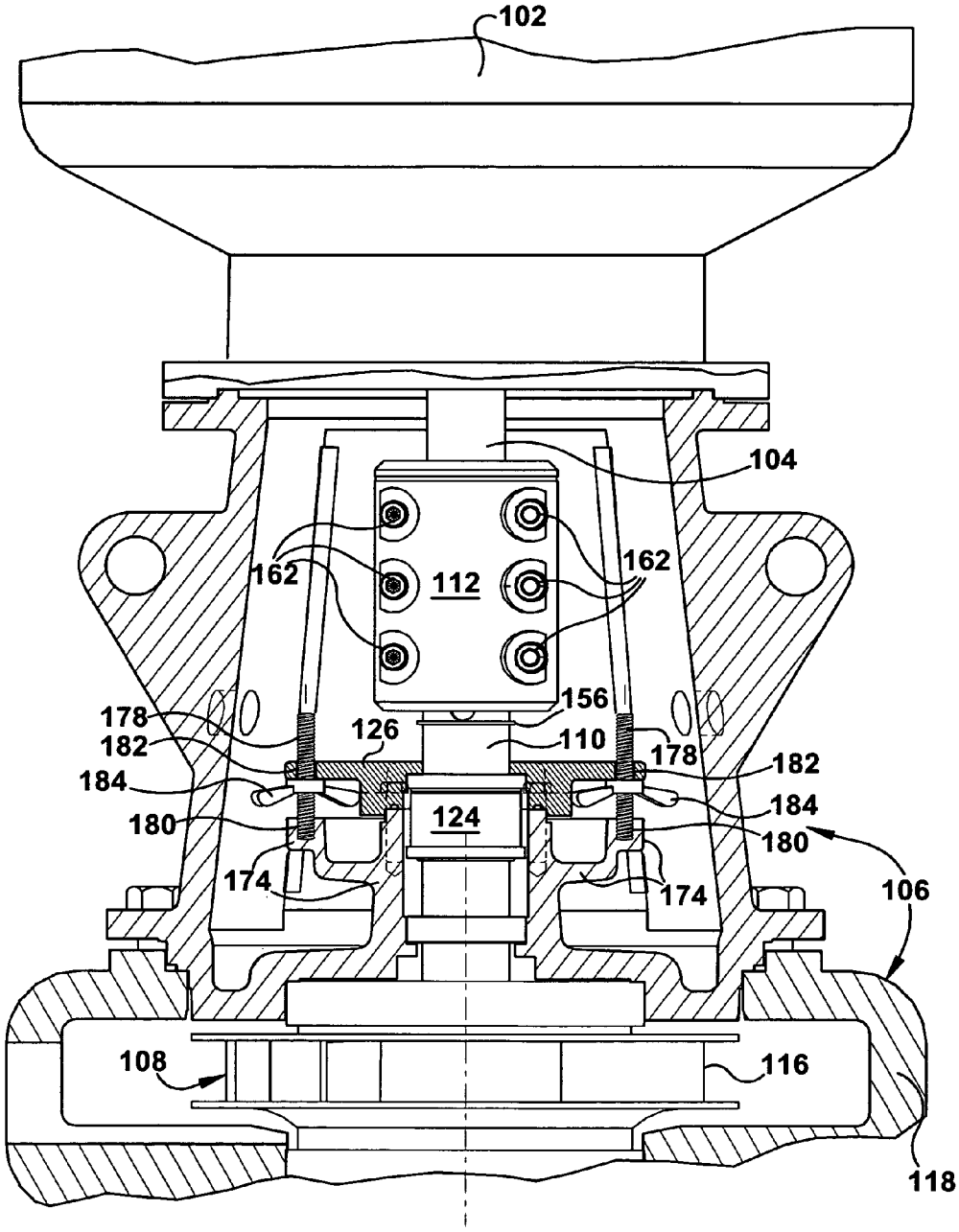
FIG. 3 illustrates a partial cross-section view of the coupling assembly and jacking assembly of FIG. 1 in a fastened position.

FIGS. 1 through 3 show best split coupling assembly 112 used to secure pump shaft 110 to motor shaft 104 for rotation therewith. Split coupling assembly 112, which has a forward end 112*a* and a rearward end 112*b*, includes two semi-cylindrical sleeve halves 158 and 160. In assembly sleeve halves 158 and 160 are secured to each other to form split coupling assembly 112 by any suitable attachment means. Suitable attachment means include, but are not limited to, screws, bolts and pins. In one embodiment, sleeve halves 158 and 160 are joined by threaded cap screws 162 (FIG. 3). Cap screws 162 are provided at spaced locations and are insertable through bore holes 164 formed at longitudinally spaced locations through sleeve half 160, and which are each positioned for alignment with a corresponding internally threaded sockets 166 formed within the second sleeve half 158. When assembled, split coupling assembly 112 further defines a central bore 168 along its axial center. As would be appreciated by one of skill in the art, central bore 168 is designed to receive motor shaft 104 and the upper portion 110*a* of pump shaft 110. Accordingly, the contour of central bore 168 is designed to include a key that is sized to fit in keyway 152 and to accommodate keys 140 and 150, as well as any potential diameter variances in motor shaft 104 and/or the upper portion 110*a* of pump shaft 110.

The cooperative function of mechanical seal 124 and seal gland 126 will now be discussed with reference to FIGS. 1 through 5. As can be seen in FIGS. 1 and 3, mechanical seal 124 has a cylindrical opening 170 having a suitably sized interior diameter so as to fit snugly around portion 110*b* of pump shaft 110. On the exterior surface thereof mechanical seal 124 has a collar portion 172 having a greater exterior diameter than the remainder of mechanical seal 124. As can be seen from FIG. 3, the collar portion 172 of mechanical seal 124 is designed so as to fit into the underside of seal gland 126. Mechanical seal 124 is kept in place on portion 110*b* of pump shaft 110 via its engagement with seal gland 126 and via snap ring 194 (FIG. 2). Pump shaft 110 also includes a third annular groove 192 that is designed to receive snap ring 194.

Snap ring 194 acts as a lower stop and/or rest for mechanical seal 124. Seal gland 126 is removably mounted onto bracket portion 174 of impeller housing 118 via any suitable attachment means. Suitable attachment means include, but are not limited to bolts, screws and pins. In one embodiment, seal gland 126 is removably mounted onto bracket portion 174 of impeller housing 118 via bolts 176 (FIG. 2).

Seal gland 126 also acts as a jacking gland, as will be explained below, when pump 100 is being serviced. In this regard, seal gland and/or jacking gland 126 contains at least two threaded jacking screws 178. It should be noted that the present invention is not limited to just two jacking screws, additional jacking screws can be utilized if so desired.

As can be seen from FIGS. 1 through 5, threaded jacking screws 178 connect bracket portion 174 of impeller housing 118 to jacking gland 126 via thread receiving mounts 180 in bracket portion 174 (see FIG. 3) and threaded screw holes 182 in jacking gland 126. The level of the jacking gland 126 relative to bracket portion 174 of impeller housing 118 can be adjusted as desired using jacking wing nuts 184 which are located between the bottom of jacking gland 126 and bracket portion 174 on threaded jacking screws 178. In another embodiment, jacking wing nuts 184 can be any suitably sized non-wing nuts so long as a pump operator/mechanic can easily rotate the nuts when desired. Jacking gland 126 can only be raised as far as retaining ring 156 since the diameter of the cylindrical opening 186 (FIG. 1) in jacking gland 126 is designed to be slight slightly smaller in diameter than the outer diameter of retaining ring 156. Thus, retaining ring 156 acts as an upper stop for jacking gland 126'. As will be apparent to the one skilled in the art, bracket portion 174 of impeller housing 118 acts as a lower stop for jacking gland 126.

In another embodiment, retaining ring 156 can be replaced by any suitable structure designed to act as an upper stop for jacking gland 126. Such structures include, but are not limited to, a stop pin that protrudes from at least one side of pump shaft 110 or a shoulder of increased diameter that is formed on pump shaft 110.

Next a method will be described for raising and lowering jacking gland 126. This in turn raises and lowers pump shaft 110 and impeller assembly 108 which can permit among other things, the servicing of pump 100. The method of raising and lowing pump shaft 110 and impeller assembly 108 utilizes the following components: seal gland/jacking gland land 126, threaded jacking screws 178; jacking wing nuts 184; and retaining ring 156. It should be noted that the present invention is not limited to solely the method discussed below. Any modifications or alternations to the following method are also covered so long as the method of raising and lowering pump shaft 110 and impeller assembly 108 permits at least the servicing of pump 100.

Figure 4:
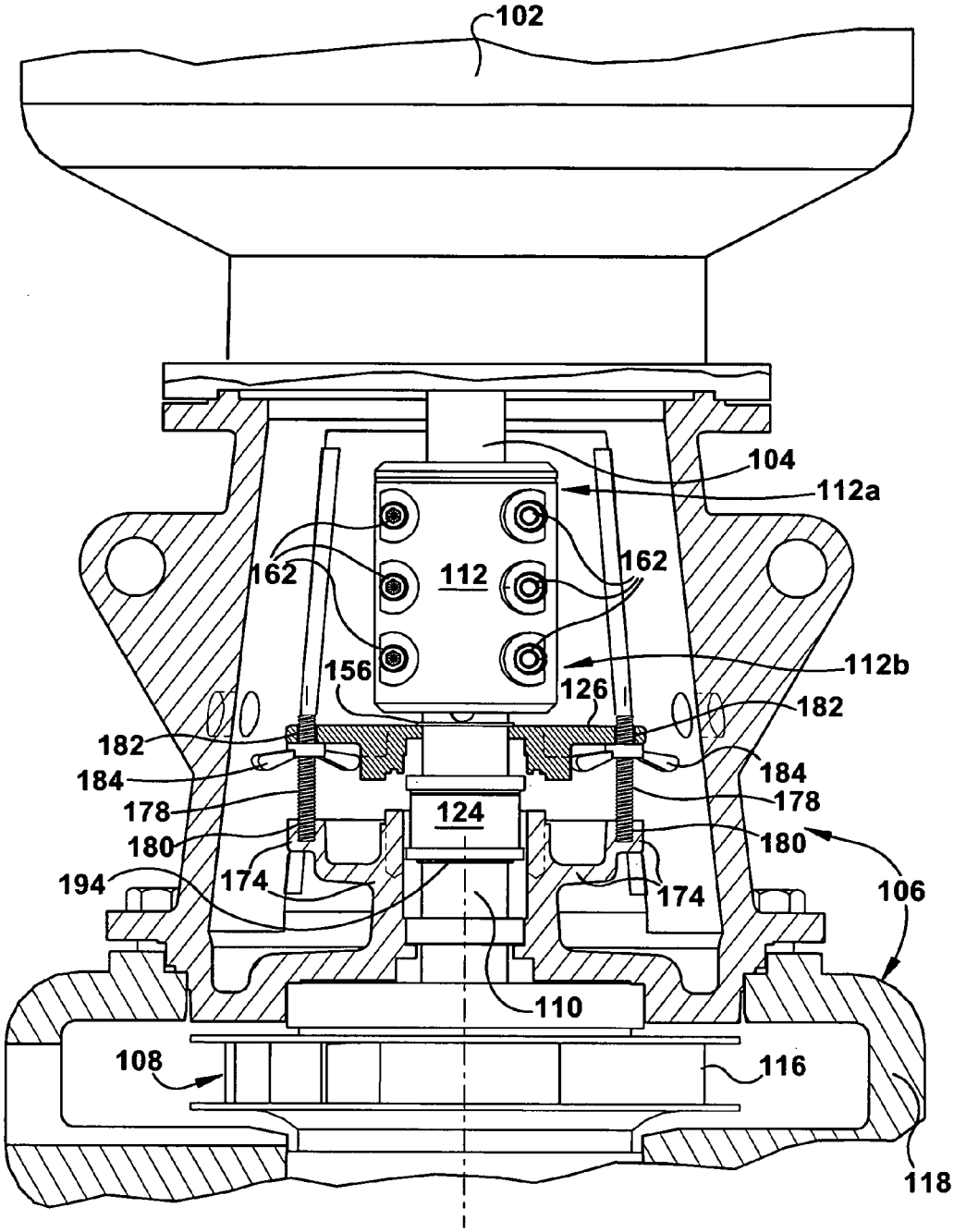
FIG. 4 illustrates a partial cross-section view of the coupling assembly and jacking assembly of FIG. 1 in a partially lifted position.

Initially, jacking wing nuts 184 are turned in an appropriate direction so as to raise jacking gland 126 until it comes into contact retaining ring 156. In this position pump shaft 110 and impeller assembly 108 are now supported by jacking gland 126 (FIG. 4). Given this situation, rigid split coupling 112 can be removed by removing cap screws 162 therefrom. Next, jacking wing nuts 184 are rotated on threaded jacking screws 178 until pump shaft 110 and impeller assembly 108 are lowered a sufficient amount and comes to rest on impeller resting step 190 (FIG. 5). Retaining ring 156 and key 150 can then be removed from pump shaft 110, thereby permitting the removal of jacking gland 126 via the upper end 142 of pump shaft 110. At this point, mechanical seal 124 can be removed and replaced. Pump 100 is the reassembled by repeating the above process in reverse order.

Among the advantages of the present invention, is the ability of one person, mechanic and/or service technician to service pump 100 with only a set of simple hand tools.

Although the invention has been described in detail with particular reference to certain embodiments detailed herein, other embodiments can achieve the same results. Variations and modifications of the present invention will be obvious to those skilled in the art and the present invention is intended to cover in the appended claims all such modifications and equivalents.

What is claimed is:

1. A pump comprising:

a motor;

a motor shaft coupled to the motor;

a pump housing including an impeller housing with an impeller, the pump housing having an interior portion receiving the motor shaft and having a bracket portion;

a driven shaft extending within the interior portion of the pump housing, the driven shaft having a perimeter including an annular groove, the driven shaft having a lower end rotatably received within the bracket portion and secured to the impeller;

a split coupling sleeve connected to the motor shaft and the driven shaft within the interior portion of the pump housing;

a seal gland positioned around the driven shaft and being selectively secured against axially sliding movement relative to the driven shaft, the seal gland surrounding the perimeter of the driven shaft;

a key including two semi-circular portions received by the annular groove of the driven shaft and engaging an interior of the split coupling sleeve;

a seal positioned adjacent to the seal gland, the seal surrounding the perimeter of the driven within the bracket portion of the pump housing; and at least one threaded jack screw extending from the bracket portion and being insertable axially through a side portion of the seal gland, the at least one threaded jack screw permitting movement of the seal gland in an axial direction after the seal gland has been unsecured by moving a nut upward along the at least one threaded jack screw in order to lift the seal gland and allow removal of the seal from the driven shaft, the driven shaft extending through a central portion of the seal gland a distance from the side portion of the seal gland, the at least one threaded jack screw coupling the seal gland to the bracket portion of the impeller housing.

2. The pump of claim 1, further comprising a stopping structure located on the driven shaft, the stopping structure being designed to limit the axial movement of the seal gland.

3. The pump of claim 2, wherein the stopping structure is a retaining ring designed to fit around the driven shaft.

4. The pump of claim 2, wherein the stopping structure is a retaining pin designed to protrude from at least one surface of the driven shaft.

* * * * *